US011543205B2

(12) United States Patent
Holly et al.

(10) Patent No.: US 11,543,205 B2
(45) Date of Patent: Jan. 3, 2023

(54) MUZZLE BRAKE FOR MUZZLE-LOADING FIREARM

(71) Applicant: BLACKPOWDER PRODUCTS, INC., Lawrenceville, GA (US)

(72) Inventors: Michael B. Holly, Richmond Hill, GA (US); Mark D. Hendricks, Duluth, GA (US)

(73) Assignee: BLACKPOWDER PRODUCTS, INC., Lawrenceville, GA (US)

( * ) Notice: Subject to any disclaimer, the term of this patent is extended or adjusted under 35 U.S.C. 154(b) by 0 days.

(21) Appl. No.: 17/395,501

(22) Filed: Aug. 6, 2021

(65) Prior Publication Data

US 2022/0042759 A1 Feb. 10, 2022

Related U.S. Application Data

(60) Provisional application No. 63/062,533, filed on Aug. 7, 2020.

(51) Int. Cl.
*F41A 21/36* (2006.01)
*F41C 9/08* (2006.01)

(52) U.S. Cl.
CPC ..... *F41A 21/36* (2013.01); *F41C 9/085* (2013.01)

(58) Field of Classification Search
CPC ..... F41H 5/0485; F41H 5/013; F41H 5/06
USPC ..... 89/36.02
See application file for complete search history.

(56) References Cited

U.S. PATENT DOCUMENTS 5,333,529 A * 8/1994 Brockman ..... F41A 21/38 89/14.3
2018/0017352 A1* 1/2018 Addis ..... F41A 21/36
2020/0072574 A1* 3/2020 Griffitts ..... F41A 21/36
2022/0042759 A1* 2/2022 Holly ..... F41A 21/36

FOREIGN PATENT DOCUMENTS

WO WO-2017171980 A2 * 10/2017 ..... F41A 21/28

OTHER PUBLICATIONS

"Mechforce Enforcer Muzzle Brakes" by 'Ray I.'; published Dec. 13, 2016; https://www.thefirearmblog.com/blog/2016/12/13/mechforce-enforcer-muzzle-brakes/ (Year: 2016).*
Screenshot of video titled "CVA Paramount Pro—Everything you need to know | Long Range Muzzleloading with CVA" published by National Muzzle Loading Rifle Association on Apr. 14, 2020; https://www.youtube.com/watch?v=yw2z5tB65gc (Year: 2020).*

(Continued)

*Primary Examiner* — Samir Abdosh
(74) *Attorney, Agent, or Firm* — Gardner Groff & Greenwald, PC

(57) ABSTRACT

A muzzle brake for use with a firearm such as a muzzle-loading firearm, and including at least one access port in the muzzle brake that is large enough (for example at least about 0.5" or more minimum dimension) for access by a user's fingertip to remove a cleaning patch from the muzzle brake. One or more vent ports that are relatively smaller than the access port may also be provided in the muzzle brake.

24 Claims, 5 Drawing Sheets

(56) References Cited

OTHER PUBLICATIONS

"OPS Muzzle Brake Stainless Installed," EABCO <https://www.eabco.net/OPS-Muzzle-Brake-Stainless-Installed_p_13241.html>, 1 page, Dec. 17, 2014, retrieved from Internet Archive Wayback Machine <http://web.archive.org/web/20141217193725/https://www.eabco.net/OPS-Muzzle-Brake-Stainless-Installed_p_13241.html> on Apr. 17, 2022.

"Recoil Hawg Muzzle Break," Browning <https://www.browning.com/products/shooting-accessories/misc/recoil-hawg-muzzle-brake.html>, 1 page, May 17, 2021, retrieved from Internet Archive Wayback Macine <http://web.archive.org/web/20210517225107/https://www.browning.com/products/shooting-accessories/misc/recoil-hawg-muzzle-brake.html> on Apr. 17, 2022.

* cited by examiner

MUZZLE BRAKE FOR MUZZLE-LOADING FIREARM

CROSS-REFERENCE TO RELATED APPLICATION

This application claims the benefit of U.S. Provisional Patent Application Ser. No. 63/062,533 filed Aug. 7, 2020, the entirety of which is hereby incorporated herein by reference for all purposes.

TECHNICAL FIELD

The present invention relates generally to the field of firearms accessories, and more particularly to a muzzle brake for muzzle-loading firearms.

BACKGROUND

A muzzle brake or recoil compensator is a device or feature connected to or integral with the construction of the muzzle or barrel of a firearm or cannon, which is intended to redirect a portion of propellant gases to counter recoil and unwanted muzzle rise. Muzzle brakes typically include vents in the form of slots or holes to partially divert combustion gasses from a firing charge at an angle offset from the long axis of the barrel or bore of the firearm. The direction of the venting and the resulting momentum of the diverted gasses may be used to counter muzzle rise, reduce recoil felt by the shooter, and/or for other purposes.

Muzzle brakes have generally been found to be incompatible or difficult to use with muzzleloaders or muzzle-loading firearms. Typically, the bore of a muzzle-loading firearm's barrel is cleaned after use or between shots by inserting a cleaning patch into the bore through the barrel's muzzle, running the patch through the bore, and withdrawing the patch out of the bore through the muzzle. The cleaning patch is typically carried through the bore on a cleaning jag attached to the end of the ramrod or a cleaning rod. Because muzzleloaders commonly have a breechplug that blocks the breech end of the barrel, the patch cannot be pushed all the way through the barrel and removed from the breech end unless the breechplug is removed. Removing the breechplug between shots is time consuming and impractical. The bore diameter of a muzzle brake is typically only slightly larger than the bore diameter of the barrel. Thus, if a cleaning patch is withdrawn from the muzzle through a conventional muzzle brake, the patch tends to expand away from the cleaning jag and get tangled in the ports of the conventional muzzle brake where it can be difficult to remove and can interfere with proper venting.

Accordingly, it can be seen that needs exist for an improved muzzle brake that is compatible for use with muzzle-loading firearms. It is to the provision of an improved muzzle brake meeting these and other needs that the present invention is primarily directed.

SUMMARY

In example forms, the present invention provides an improved muzzle brake that is compatible for use with muzzle-loading firearms. In example embodiments, the muzzle brake includes one or more enlarged access ports configured to catch a cleaning patch upon retraction from the firearm's barrel and allow finger access by a user to remove the patch from the muzzle brake. The muzzle brake may further include one or more smaller vent ports separate from the larger access port(s) for venting of propellant combustion gasses. In this manner, a user may clean the bore of a muzzleloader in typical fashion, inserting the cleaning patch through the muzzle brake and into the bore of the firearm, and after cleaning the patch is withdrawn out of the muzzle end of the bore and removed by the user inserting a finger through the access port.

In one aspect, the present invention relates to a muzzle brake for a firearm, the muzzle brake preferably including at least one access port having a minimum dimension configured to allow access by a user's fingertip.

In another aspect, the invention relates to a method of cleaning a bore of a muzzle-loading firearm, the firearm having a muzzle brake attached thereto. The method preferably includes inserting a cleaning patch into a muzzle end of the bore of the firearm, cleaning the bore with the patch, and removing the patch through an access port in the muzzle brake, wherein the access port is configured to allow insertion of a user's fingertip therein.

In another aspect, the invention relates to a muzzle brake for a muzzle-loading firearm. The muzzle brake preferably includes an elongate body having a projectile bore extending therethrough along a longitudinal axis, with a first end of the elongate body including coupling means for attachment to the muzzle of a firearm. The muzzle brake preferably also includes at least one access port extending generally transverse to the longitudinal axis through a sidewall of the elongate body and into communication with the projectile bore, and at least one vent port extending generally transverse to the longitudinal axis through the sidewall of the elongate body and into communication with the projectile bore. The at least one access port preferably has an opening size with a minimum access opening dimension of at least 0.5", the at least one vent port preferably has a vent opening dimension smaller than the minimum access opening dimension, and the at least one access port is preferably positioned between the first end of the elongate body and the at least one vent port.

These and other aspects, features and advantages of the invention will be understood with reference to the drawing figures and detailed description herein and will be realized by means of the various elements and combinations particularly pointed out in the appended claims. It is to be understood that both the foregoing general description and the following brief description of the drawings and detailed description of example embodiments are explanatory of example embodiments of the invention, and are not restrictive of the invention, as claimed.

DETAILED DESCRIPTION OF EXAMPLE EMBODIMENTS

The present invention may be understood more readily by reference to the following detailed description of example embodiments taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
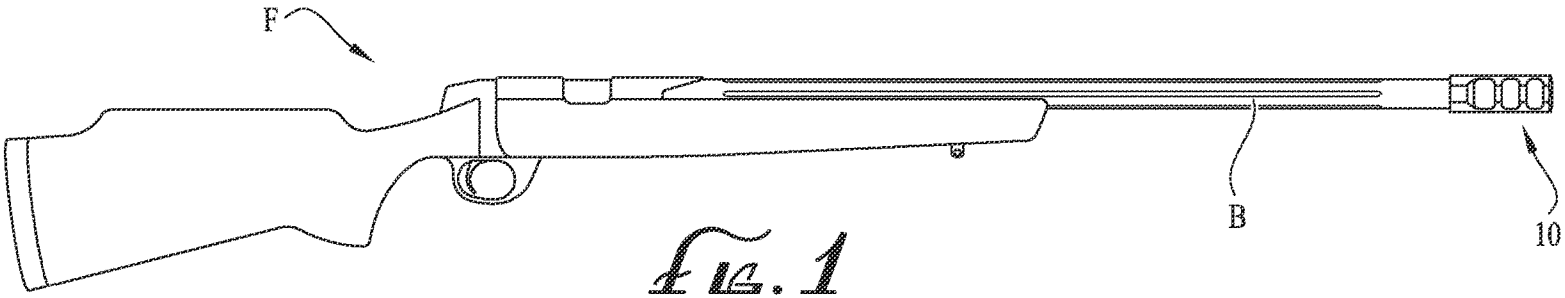
FIG. 1 is a side view of a firearm with a muzzle brake according to an example embodiment of the present invention mounted on the muzzle of the firearm.

With reference now to the drawing figures, wherein like reference numbers represent corresponding parts throughout the several views, FIG. 1 shows a muzzle brake 10 according to an example embodiment of the present invention, mounted to the muzzle end of the barrel B of a firearm F. In example embodiments, the muzzle brake 10 is machined as a unitary integral component from a single continuous piece of steel bar or rod stock. In alternate embodiments, the muzzle brake can be formed as an assembly, and or comprised of other metals, ceramic, composite and/or other materials of construction. In example forms, the muzzle brake generally comprises an elongate body having a projectile bore extending therethrough along a longitudinal axis, and sidewalls at least partially surrounding the projectile bore and transversely offset therefrom. In the depicted embodiment, the firearm F to which the muzzle brake 10 is attached is a modern muzzle-loading rifle. In alternate uses, the muzzle brake 10 may be mounted to modern or primitive muzzle-loading rifles, pistols, shotguns, cannons, or alternatively may be utilized with breech-loading firearms or firearms of various formats.

Figure 3:
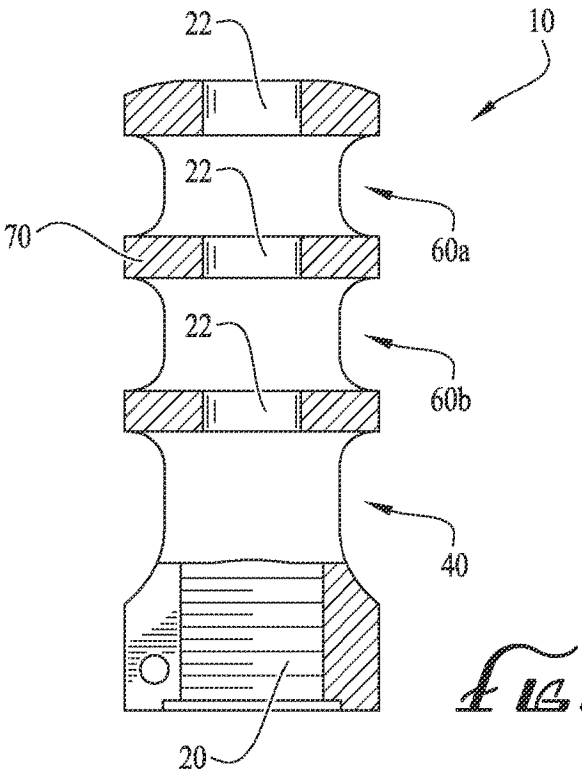
FIG. 3 is a side cross-sectional view of the muzzle brake of FIG. 2, taken along section lines 3-3 in FIG. 2.
Figure 2:
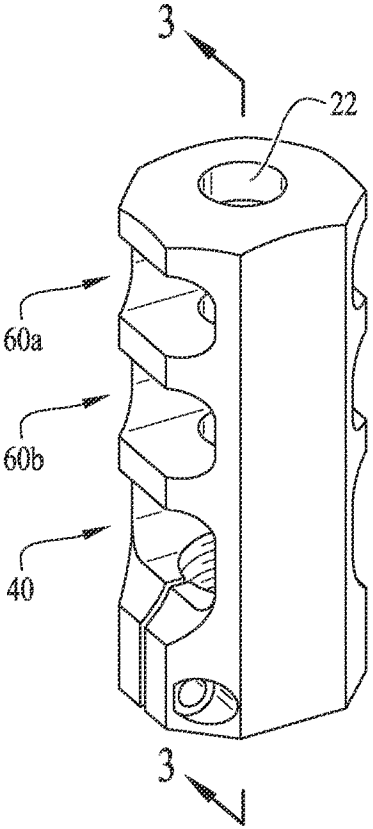
FIG. 2 is a perspective view of a muzzle brake according to an example embodiment of the invention.
Figure 4A:
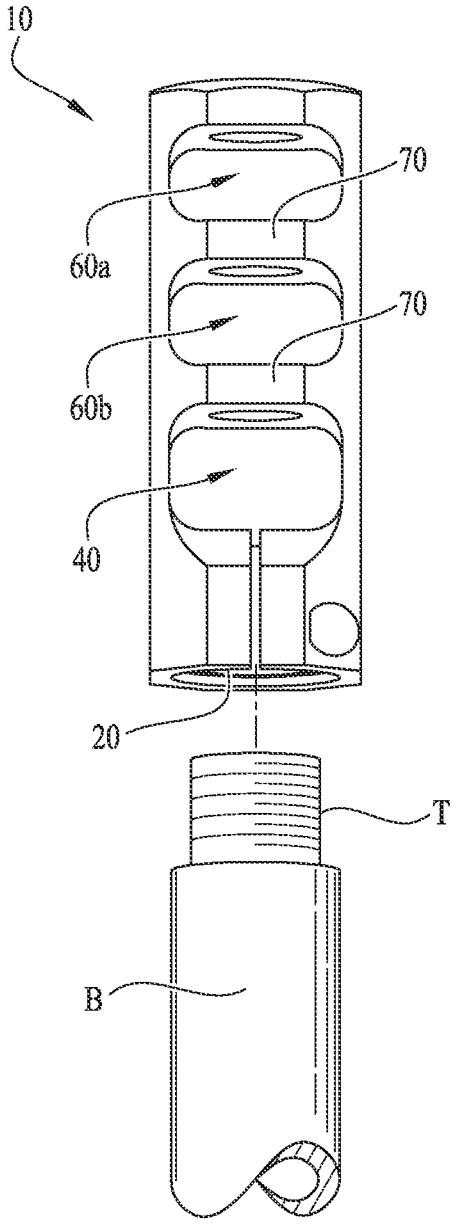
FIGS. 4A and 4B (collectively, FIG. 4) are assembly views showing an example method of installation of a muzzle brake onto the muzzle end of a barrel of a muzzle-loading firearm.
Figure 4B:
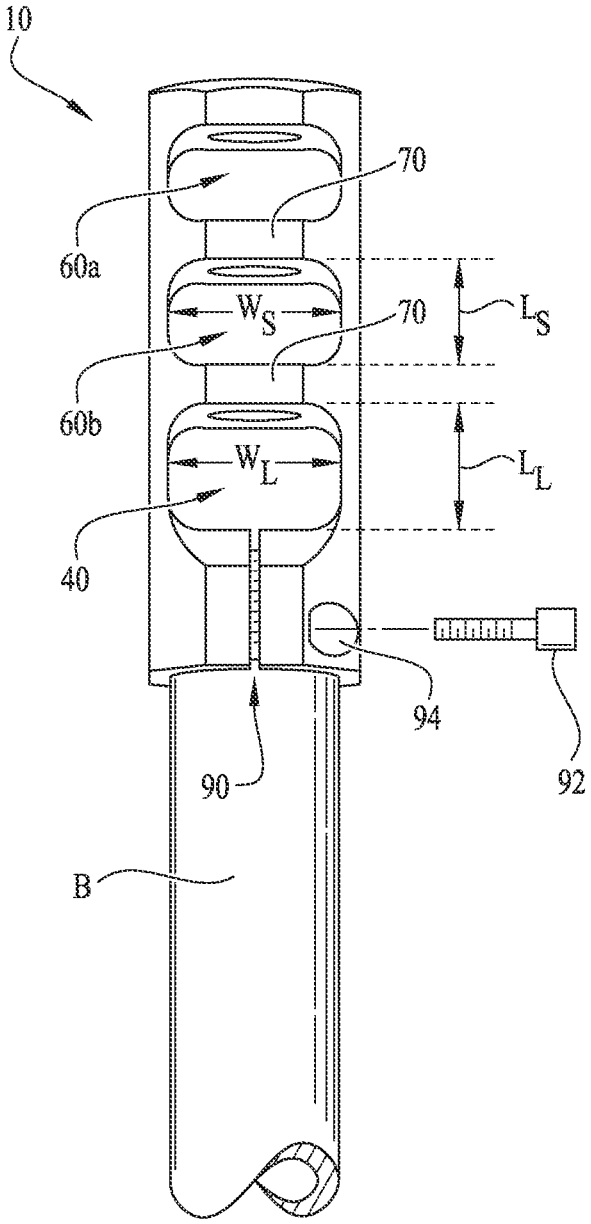

As shown in FIGS. 2-4, the muzzle brake 10 has a female or internally threaded attachment bore 20 at its proximal end, configured for detachably coupling with a corresponding or cooperatively configured male or externally threaded extension at the muzzle end of the barrel B of the firearm. In alternate embodiments, the muzzle brake is integrally formed with or permanently affixed or coupled to the barrel of the firearm, for example by welding, adhesive, compression fit, screws or other attachment or coupling means. The muzzle brake 10 also includes an axial projectile bore 22 extending lengthwise through the entire brake from its proximal end to its distal end. The attachment bore 20 and the projectile bore 22 are coaxially configured, so that when the muzzle brake 10 is installed onto the firearm for use (FIG. 4B), the projectile bore is precisely and coaxially aligned with the internal longitudinal bore axis of the barrel B. The projectile bore 22 preferably has a diameter slightly larger than the bore of the barrel B of the firearm F to which the muzzle brake 10 is configured for use in connection with (for example, a diameter of about 0.43" for a .40 caliber firearm, 0.48" for a .45 caliber firearm, or 0.53" diameter for a .50 caliber firearm) to allow free passage of a fired projectile of the intended caliber with a sufficiently close fit to partially deflect propellant combustion gasses to an offset angle relative to the bore axis when the firearm is fired. Optionally, the muzzle brake 10 may be marked on an external surface with the caliber of the firearm for which it is configured, and/or with branding indicia, safety warnings, use instructions, and/or other information or indicia, for example by printing, stamping, labeling, indentation, etching, engraving, embossing, molding, or otherwise. Further optionally, the attachment end or coupling of the muzzle brake may be indexed or otherwise configured to allow attachment of the brake only to firearms of the intended caliber and/or type.

The muzzle brake 10 also comprises at least one larger access port 40 extending generally crosswise (i.e., transversely) to the axis of the projectile bore 22. In the depicted embodiment, the larger access ports 40 extend generally perpendicular (90°) to the axis of the projectile bore 22, but in alternate embodiments may be obliquely oriented. In the depicted embodiment, an opposed pair of two larger access ports 40 are provided, aligned across from one another and extending transversely continuously through the muzzle brake 10, with a first larger access port exiting or venting in a first transverse direction from one side of the muzzle brake, and a second larger access port exiting or venting in an opposite second transverse direction from the opposite side of the muzzle brake. The larger access ports 40 extend in fluid communication with the projectile bore 22 to allow passage of propellant combustion gasses therefrom. The one or more larger access port(s) 40 are preferably configured with a minimum dimension (e.g., length or width) that is at least large enough to allow insertion of an average person's fingertip (e.g., pinkie or index finger), for access to remove a cleaning patch or other objects as will be described herein. In example embodiments, the larger access port(s) 40 have a minimum opening dimension of at least about 0.5", more preferably at least about 0.6" to 0.8", and in particular embodiments at least about 0.65" or 0.75", for example about 0.65" long (LL) and about 0.900 wide (WO. In example embodiments, the external opening of the larger access port(s) 40 may be beveled or rounded for ease of access, and all internal and external edges may be rounded or radiused to remove sharp edges.

The muzzle brake 10 optionally also comprises at least one smaller vent port 60 in fluid communication with the projectile bore 22, for venting propellant combustion gasses when the firearm is fired. In the depicted embodiment, two axially spaced, transversely opposed pairs 60*a*, 60*b* of smaller vent ports are provided. The smaller vent ports 60 preferably have at least one dimension (e.g., length and/or width) that is smaller than the minimum dimension of the larger access ports 40. In this manner, the smaller vent port(s) 60 are relatively smaller in at least one aspect than the relatively larger vent port(s) 40. In example embodiments, the smaller vent port(s) 60 has/have an opening dimension in at least one dimension that is equal to or less than the corresponding dimension of the larger access port (s). For example, in example embodiments the smaller vent port(s) 60 may have opening dimensions of about 0.55", 0.50" or less long (Ls) and about 0.90" wide (Ws).

In the depicted embodiment, three opposed pairs of ports (one pair of larger access ports 40 and two pairs of smaller vent ports 60) are provided. The larger access ports 40 are preferably positioned toward the proximal end of the muzzle brake 10 (adjacent or proximal to the attachment end 20), and the smaller vent ports 60 are preferably positioned toward the distal end of the muzzle brake 10 (opposite or distal from the attachment end 20). Thus, when the muzzle brake 10 is installed on the firearm F, the larger access ports 40 are closer to the muzzle end of the barrel than the smaller vent ports 60, and when used in connection with cleaning of the barrel bore the larger access ports catch the cleaning patch as it exits the barrel for easy removal by the user.

The at least one larger access port(s) 40 and the at least one smaller vent port(s) 60 are spaced axially a distance from one another along the length of the muzzle brake 10 and are separated from one other by transversely extending baffle walls 70, comprising webs or flanges of structural material through which the projectile bore 22 passes. In example embodiments, the baffle walls 70 have a minimum thickness of at least about ⅓ the bore diameter or caliber of the firearm F with which the muzzle brake 10 will be used. For example, a muzzle brake 10 for a .50 caliber firearm will have baffle walls 70 at least about 0.166" thick, for a .45 caliber firearm baffle walls at least about 0.15" thick, and for a .40 caliber firearm baffle walls at least about 0.133 thick. In further example embodiments, the baffle walls 70 have a thickness of at least about 0.125", for example about 0.200".

Figure 5:
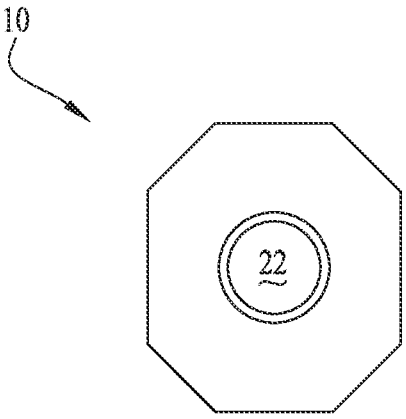
FIG. 5 is an end view of the muzzle brake of FIG. 2.

FIGS. 4A and 4B show an example manner or method of installation or mounting of a muzzle brake 10, according to an example form of the invention. The muzzle end of the barrel B of the firearm F may be provided with male threads T. Cooperatively configured female threads of the attachment or coupling end 20 of the muzzle brake 10 are threaded onto the male threads T of the firearm muzzle and tightened to securely attach the muzzle brake 10 to the barrel B. Optionally, a clamping slot 90 may be provided at the coupling end 20 of the muzzle brake 10, and a clamping screw 92 may be inserted into a threaded clamping bore 94 to draw the clamping slot together and further tighten and secure the muzzle brake to the barrel. Optionally, the muzzle brake 10 may have an octagonal or other polygonal external profile in plan or end view, as shown in FIG. 5, to assist the user in gripping the brake when installing and removing the brake from the barrel B.

Figure 6A:
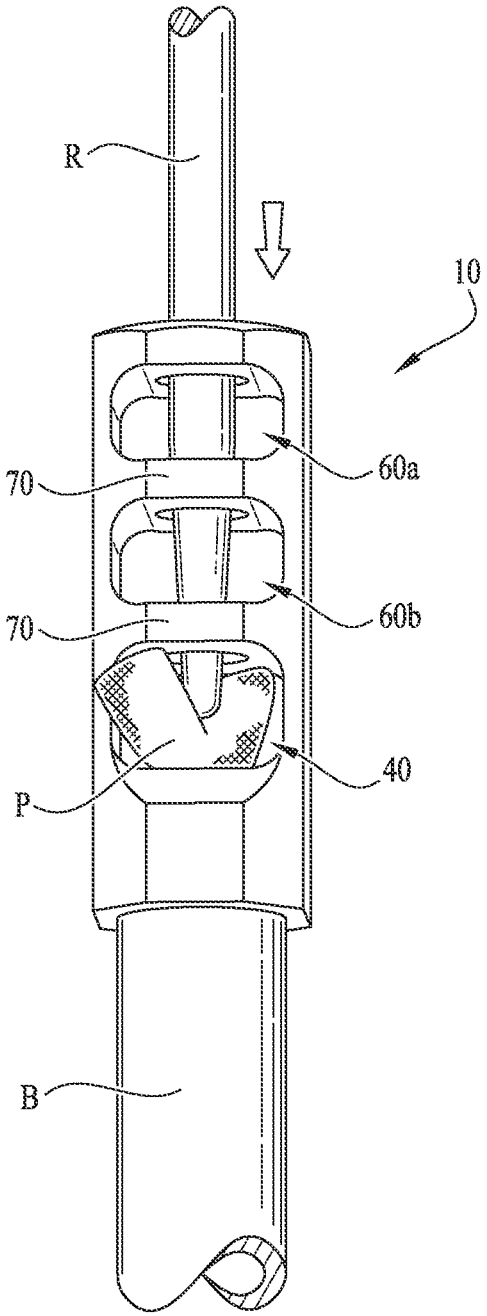
FIGS. 6A, 6B and 6C (collectively, FIG. 6) show an example sequence or method of use of a muzzle brake in connection with the cleaning of the bore of a barrel of a muzzle-loading firearm with a cleaning patch.
Figure 6B:
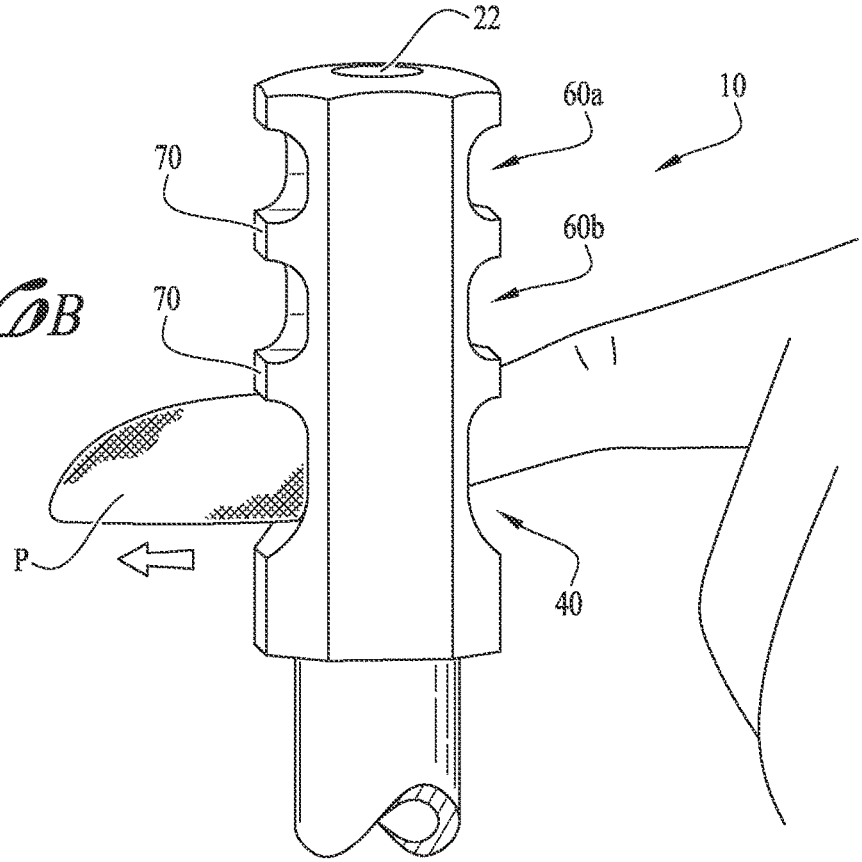
Figure 6C:
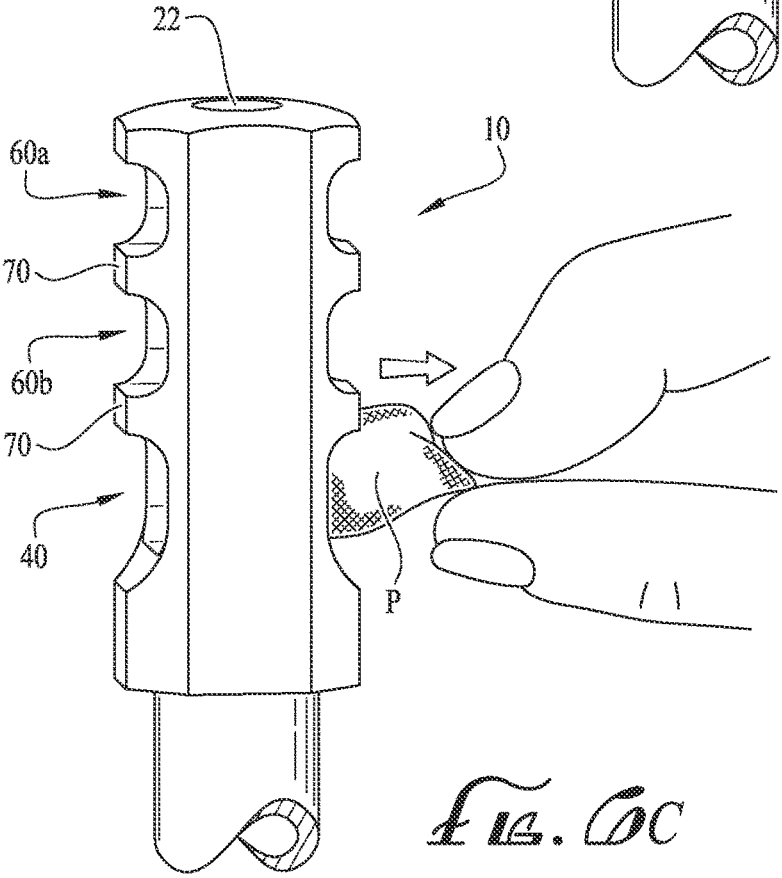

FIGS. 6A, 6B and 6C show example modes of use or operation of a muzzle brake 10 during cleaning of the barrel B of a muzzle-loading firearm. A cleaning patch P is inserted through the projectile bore 22 of the muzzle brake and into the muzzle end of the barrel B of the firearm F using a ramrod or other elongate tool, for example a cleaning rod R having a cleaning jag attached at the end of the tool for engaging the cleaning patch. The patch P may have a cleaning solvent or other material applied thereon. The patch is inserted and moved through the bore of the barrel B by advancing and retracting the rod R, to clean and remove powder residue, and/or to lubricate the bore. As the rod R is withdrawn from the barrel B after cleaning, the cleaning patch P tends to expand away from the cleaning jag on the end of the rod, contacts the first baffle wall 70, and is caught or lodges in or around the larger access ports 40 of the muzzle brake 10 (FIG. 6A). The user may then push (FIG. 6B) and/or pull (FIG. 6C) the patch P out of the larger access port 40 using their finger(s) to remove the patch P.

Figure 7:
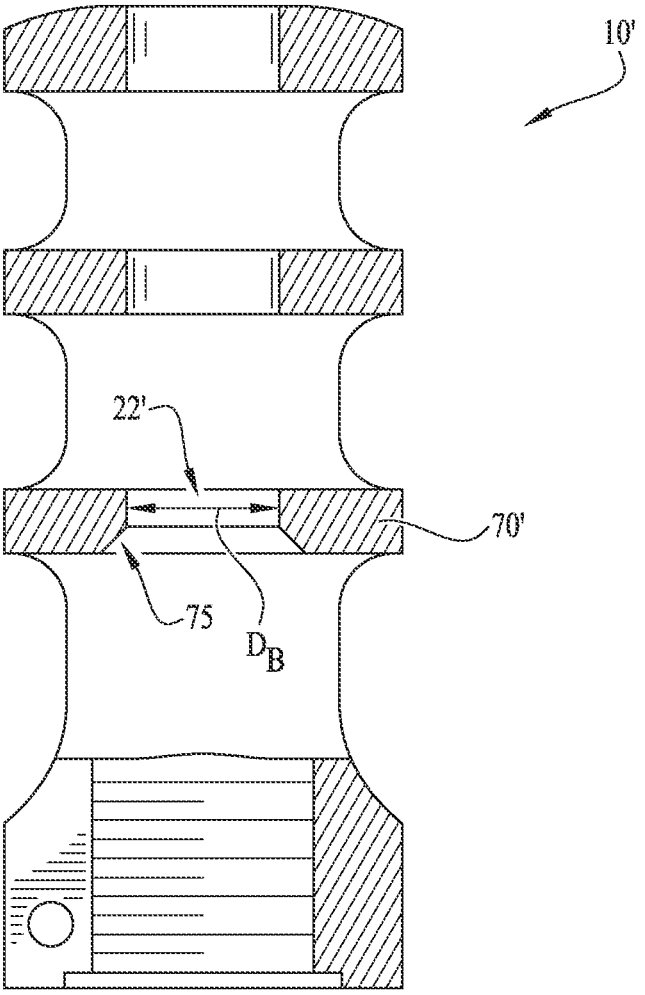
FIG. 7 shows a side cross-sectional view of a muzzle brake according to another example embodiment of the invention.

FIG. 7 shows additional details of a further embodiment of a muzzle brake 10' according to another example form of the invention. The projectile bore 22' through the first or proximal baffle 70' optionally has an enlarged bore dimension or diameter DB that is substantially greater than the diameter of the bore of the barrel B of the firearm and greater than the dimension of the projectile bores through the other (medial and distal) baffles. For example, the projectile bore 22' through the first or proximal baffle 70' may have a diameter of about 0.55" to about 0.75", or about 0.625" to about 0.675". Additionally, a chamfer, bevel, radius, or other relief feature 75 may optionally be provided around the projectile bore 22' on the proximal face of the first baffle 70'. In example embodiments, a 45° chamfer 75 of about 0.030" to about 0.050" is provided. The enlarged projectile bore 22' and chamfer 75, if provided, may reduce wear due to combustion or propellant gasses, powder burning or abrasion from particles such as plastic particles from gas-check or sabot components of projectiles, and increase the service life of the brake 10. In this manner, at least a portion of the gas and debris passes through the larger bore in the proximal baffle and impacts the medial and/or distal baffle(s), allowing the baffles to share the load of wear during use, and the chamfer may help funnel at least a portion of the gasses and particles through the brake rather than impacting the baffle squarely, also reducing or minimizing wear and extending the brake's useful life.

While the invention has been described with reference to example embodiments, it will be understood by those skilled in the art that a variety of modifications, additions and deletions are within the scope of the invention, as defined by the following claims.

What is claimed is:

1. A muzzle brake for a muzzle-loading firearm, the muzzle brake comprising a projectile bore extending axially therethrough, the projectile bore having a bore diameter of at least 0.43", and further comprising at least one access port extending generally transversely therethrough and having a minimum dimension of at least 0.5" and being configured to allow access by a user's fingertip to remove a cleaning patch though the at least one access port.

2. The muzzle brake of claim 1, wherein the minimum dimension of the at least one access port is at least 0.6".

3. The muzzle brake of claim 1, wherein the minimum dimension of the at least one access port is at least 0.65".

4. The muzzle brake of claim 1, wherein the minimum dimension of the at least one access port is at least 0.75".

5. The muzzle brake of claim 1, wherein the minimum dimension of the at least one access port is at least 0.8".

6. The muzzle brake of claim 1, further comprising at least one vent port separate from the at least one access port, wherein the at least one access port is larger than the at least one vent port.

7. The muzzle brake of claim 6, comprising one pair of larger access ports, and two opposed pairs of smaller vent ports.

8. The muzzle brake of claim 6, wherein the larger access ports are positioned closer to a proximal end of the muzzle brake, and wherein the smaller vent ports are positioned closer to a distal end of the muzzle brake.

9. The muzzle brake of claim 6, wherein the larger access ports and the smaller vent ports are spaced axially from one another and separated by at least one baffle wall.

10. The muzzle brake of claim 9, wherein the at least one baffle wall has a minimum thickness of at least 0.125".

11. The muzzle brake of claim 9, wherein the at least one baffle wall has a minimum thickness of 0.200".

12. The muzzle brake of claim 9, comprising a first baffle wall adjacent the at least one access port, and a second baffle wall adjacent the smaller vent port, and wherein a proximal baffle projectile bore portion through the first baffle wall has a larger dimension than a distal baffle projectile bore portion through the second baffle wall.

13. The muzzle brake of claim 9, further comprising a chamfer around a portion of the projectile bore through at least one of the baffle walls.

14. A muzzle brake for a muzzle-loading firearm, the muzzle brake comprising:

an elongate body having a projectile bore extending therethrough along a longitudinal axis, the projectile bore having a bore diameter of at least 0.43";

a first end of the elongate body comprising coupling means for attachment to the muzzle of a firearm;

at least one access port extending generally transverse to the longitudinal axis through a sidewall of the elongate body and into communication with the projectile bore; and at least one vent port extending generally transverse to the longitudinal axis through the sidewall of the elongate body and into communication with the projectile bore;

wherein the at least one access port has an opening size with a minimum access opening dimension of at least 0.5", wherein the at least one vent port has a vent opening dimension smaller than the minimum access opening dimension, and wherein the at least one access port is positioned between the first end of the elongate body and the at least one vent port.

15. The muzzle brake of claim 14, wherein the coupling means comprises a threaded bore.

16. The muzzle brake of claim 14, further comprising at least one baffle wall between the at least one access port and the at least one vent port.

17. The muzzle brake of claim 16, wherein the at least one baffle wall has a thickness of at least 0.125".

18. The muzzle brake of claim 16, wherein the at least one baffle wall has a thickness of at least ⅓ the bore caliber of the firearm.

19. The muzzle brake of claim 16, wherein the at least one baffle wall has a chamfer on a wall face facing the first end.

20. A method of cleaning a bore of a muzzle-loading firearm, the firearm having a muzzle brake attached thereto, the method comprising:

inserting a cleaning patch into a muzzle end of the bore of the firearm;

cleaning the bore with the patch; and removing the patch through an access port in the muzzle brake, wherein the access port is configured to allow insertion of a user's fingertip therein for removal of the patch through the access port.

21. The muzzle brake of claim 1, wherein the projectile bore has a bore diameter of at least 0.48".

22. The muzzle brake of claim 1, wherein the projectile bore has a bore diameter of at least 0.53".

23. The muzzle brake of claim 14, wherein the projectile bore has a bore diameter of at least 0.48".

24. The muzzle brake of claim 14, wherein the projectile bore has a bore diameter of at least 0.53".

* * * * *